US008646397B2

(12) United States Patent
Ysbrand

(10) Patent No.: US 8,646,397 B2
(45) Date of Patent: Feb. 11, 2014

(54) METHOD AND APPARATUS FOR PRODUCING MACHINE STITCHED FLAT WIRING HARNESS

(75) Inventor: Floyd R. Ysbrand, Carthage, MO (US)

(73) Assignee: Midcon Cables Co., Inc., Joplin, MO (US)

( * ) Notice: Subject to any disclaimer, the term of this patent is extended or adjusted under 35 U.S.C. 154(b) by 238 days.

(21) Appl. No.: 13/299,650

(22) Filed: Nov. 18, 2011

(65) Prior Publication Data

US 2012/0152160 A1 Jun. 21, 2012

Related U.S. Application Data

(60) Provisional application No. 61/424,377, filed on Dec. 17, 2010.

(51) Int. Cl.
*D05B 23/00* (2006.01)
*D05B 31/00* (2006.01)

(52) U.S. Cl.
USPC ..... 112/475.08; 112/136

(58) Field of Classification Search
USPC ..... 112/475.01, 1, 475.08, 475.17, 136, 112/152, 153
See application file for complete search history.

(56) References Cited

U.S. PATENT DOCUMENTS

| | | | | |
|---|---|---|---|---|
| 2,363,217 | A | | 11/1944 | Woodling |
| 3,033,970 | A | | 5/1962 | Paul |
| 3,257,500 | A | | 6/1966 | Rusch, Jr. et al. |
| 3,364,402 | A | | 1/1968 | Davis |
| 3,495,025 | A | | 2/1970 | Ross |
| 3,654,381 | A | | 4/1972 | Copp |
| 3,663,739 | A | * | 5/1972 | Chevrier ..... 174/36 |
| 3,792,141 | A | | 2/1974 | Offutt |
| 3,818,122 | A | | 6/1974 | Luetzow |
| 3,998,173 | A | | 12/1976 | Williamson et al. |
| 4,048,710 | A | * | 9/1977 | Nijman ..... 29/566.4 |
| 4,159,394 | A | * | 6/1979 | Ross ..... 174/72 TR |
| 4,210,999 | A | * | 7/1980 | Smith ..... 29/857 |
| 4,415,765 | A | | 11/1983 | Iwasa et al. |
| 4,441,251 | A | * | 4/1984 | Grubb ..... 29/861 |
| 4,642,873 | A | * | 2/1987 | Bower et al. ..... 29/566.3 |
| 4,723,055 | A | | 2/1988 | Bisker |
| 4,808,771 | A | | 2/1989 | Orr, Jr. |
| 5,010,642 | A | | 4/1991 | Takahashi et al. |
| 5,126,512 | A | | 6/1992 | Derry |
| 5,509,201 | A | * | 4/1996 | Ingwersen ..... 29/861 |
| 5,581,873 | A | * | 12/1996 | Okura et al. ..... 29/760 |
| 5,630,273 | A | * | 5/1997 | Kobayashi et al. ..... 29/881 |

(Continued)

FOREIGN PATENT DOCUMENTS

| | | |
|---|---|---|
| FR | 2393868 | 1/1979 |
| JP | 2004319272 | 11/2004 |
| JP | 2010018107 | 1/2010 |
| WO | WO20120082847 A1 * | 6/2012 |

*Primary Examiner* — Danny Worrell
(74) *Attorney, Agent, or Firm* — Nixon & Vanderhye, PC

(57) ABSTRACT

A method and apparatus for forming a flat wiring harness having discrete wires in a predetermined orientation. The wires are positioned in grooves in a flat form, the grooves having the predetermined orientation and the form having connected thread openings extending therethrough and across the grooves. The wires in the grooves are stitched together by a sewing machine that is programmed to guide a sewing needle and thread through the openings in the form to produce the flat wiring harness having the discrete wires in the predetermined orientation.

13 Claims, 7 Drawing Sheets

(56) References Cited

U.S. PATENT DOCUMENTS

| | | | | |
|---|---|---|---|---|
| 5,829,110 | A * | 11/1998 | Kashihara | 29/33 F |
| 5,895,034 | A * | 4/1999 | Shea | 269/3 |
| 6,608,438 | B2 | 8/2003 | Topelberg et al. | |
| 6,712,015 | B1 * | 3/2004 | Chen | 112/302 |
| 6,727,197 | B1 | 4/2004 | Wilson et al. | |
| 7,073,456 | B2 * | 7/2006 | Phillips et al. | 112/475.17 |
| 7,144,830 | B2 | 12/2006 | Hill et al. | |
| 7,248,756 | B2 | 7/2007 | Ebbesen et al. | |
| 7,290,494 | B2 * | 11/2007 | Phillips et al. | 112/475.17 |
| 7,318,271 | B2 * | 1/2008 | Yamanashi et al. | 29/748 |
| 7,592,276 | B2 | 9/2009 | Hill et al. | |
| 7,891,307 | B2 * | 2/2011 | Sakuma et al. | 112/475.17 |
| 2003/0044155 | A1 | 3/2003 | Maiden | |
| 2010/0061094 | A1 | 3/2010 | Ijzerman et al. | |

* cited by examiner

METHOD AND APPARATUS FOR PRODUCING MACHINE STITCHED FLAT WIRING HARNESS

CROSS REFERENCE TO RELATED APPLICATIONS

This application claims the priority of Provisional Patent Application No. 61/424,377, filed on Dec. 17, 2010.

BACKGROUND OF THE INVENTION

1. Field of the Invention

The present invention relates to a method and apparatus for producing a flat wiring cable or harness and, more particularly, to such a harness with discrete wires sewn in a flat configuration such that the location of each discrete wire in the harness is controlled.

2. Description of the Background Art

There have been many attempts in the prior art to produce a flat wiring cable or harness with discrete wire positioned therein. In many cases, however, the wiring harness or method of producing same have been subject to one or more of the following disadvantages:

a. The method of production has been complicated or difficult to use;
b. It has been difficult to produce flat wiring harnesses of uniform construction;
c. It has been difficult to control the positions of the discrete wires in the harness;
d. It has been difficult to produce a harness of uniformly flat configuration; and/or
e. The methods of production have been slow and thus incapable of producing flat wiring harnesses in a cost-effective manner.

The new and improved method and apparatus of the present invention is not subject to any of the above-listed disadvantages and possesses advantages not found in prior art methods and apparatus.

BRIEF SUMMARY OF THE INVENTION

In accordance with the method of the present invention, a flat wiring harness is produced with discrete wires sewn in a flat configuration such that the location of each discrete wire in the harness is controlled. Each discrete wire in the harness may be capable of carrying a unique electrical signal separate from the other wires in the harness.

The present method comprises loading the wire in grooves in a special form to control wire positioning in a predetermined orientation. The wire in the form is then sewn by inserting a sewing needle and thread through openings in the form extending across the grooves in a predetermined pattern using, for example, a computed numerically controlled (CNC) sewing machine or quilting machine to form a flat ribbon cable or harness with all of the wires maintained by the thread in the predetermined orientation in the form. The sewn flat ribbon harness is then removed from the form.

DETAILED DESCRIPTION OF THE INVENTION

Figure 1:
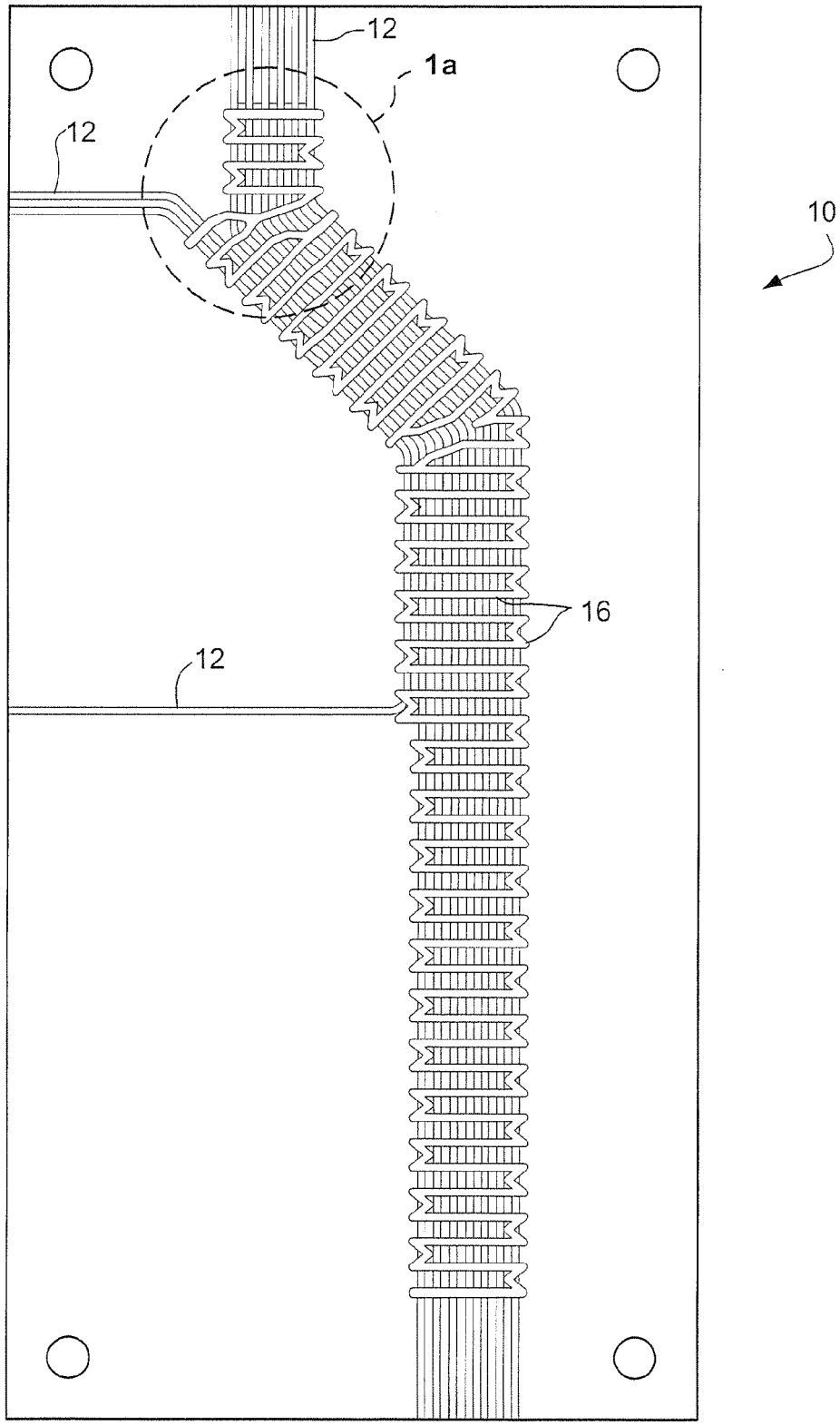
FIG. 1 is a plan view of a form having thread openings and a predetermined groove orientation in which wires may be positioned prior to being sewn together.
Figure 1A:
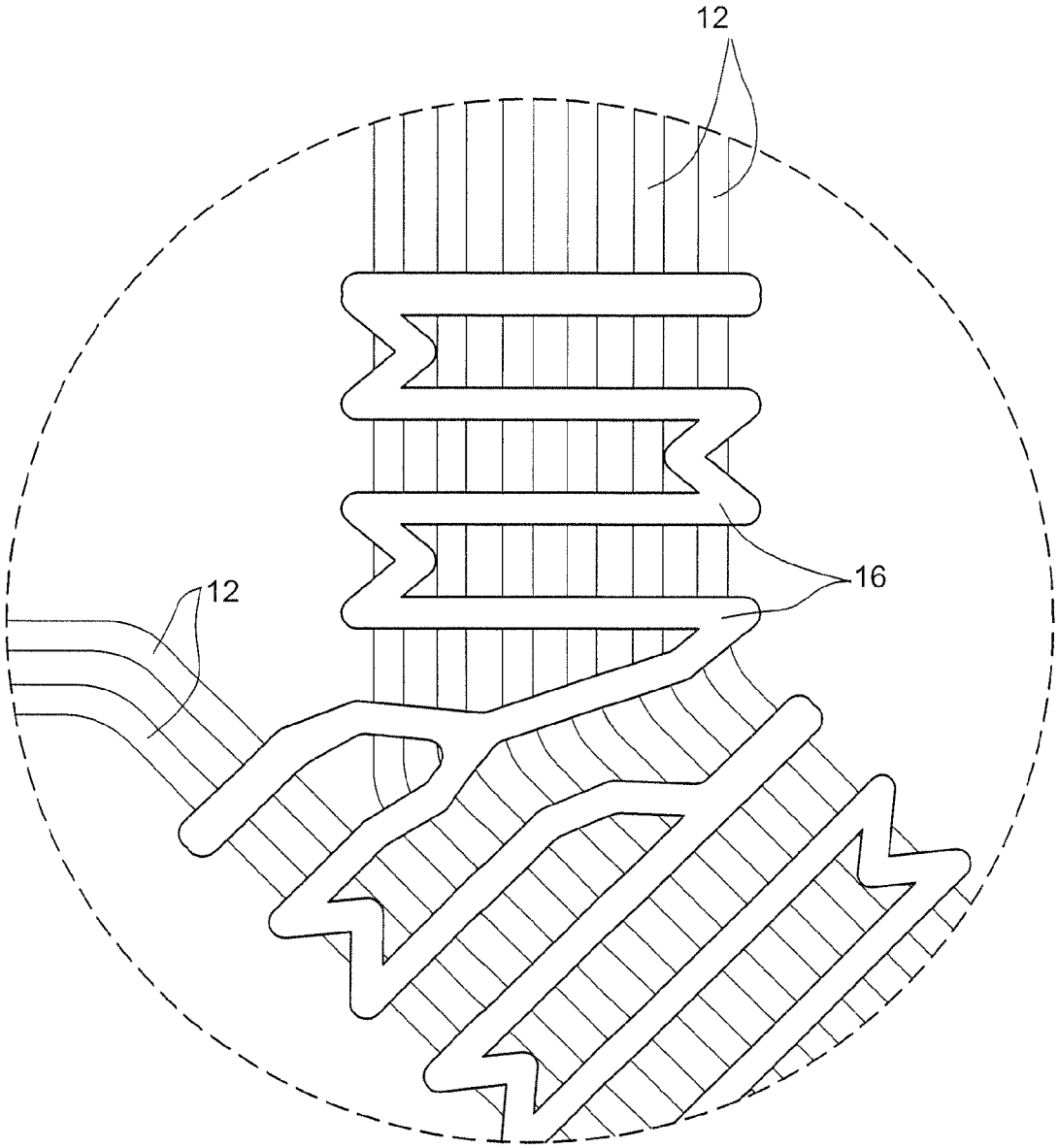
FIG. 1*a* is an enlarged plan view of a portion of the form shown in FIG. 1.

As shown in FIGS. 1 and 1*a*, the present invention uses a flat form 10 having longitudinally extending, laterally spaced grooves 12 therein in a predetermined or desired orientation which are of a size and shape to receive therein discrete wires to be sewn together in the predetermined or desired pattern. The grooves 12 may be of different sizes and shapes to accommodate different types of discrete wires.

Figure 1B:
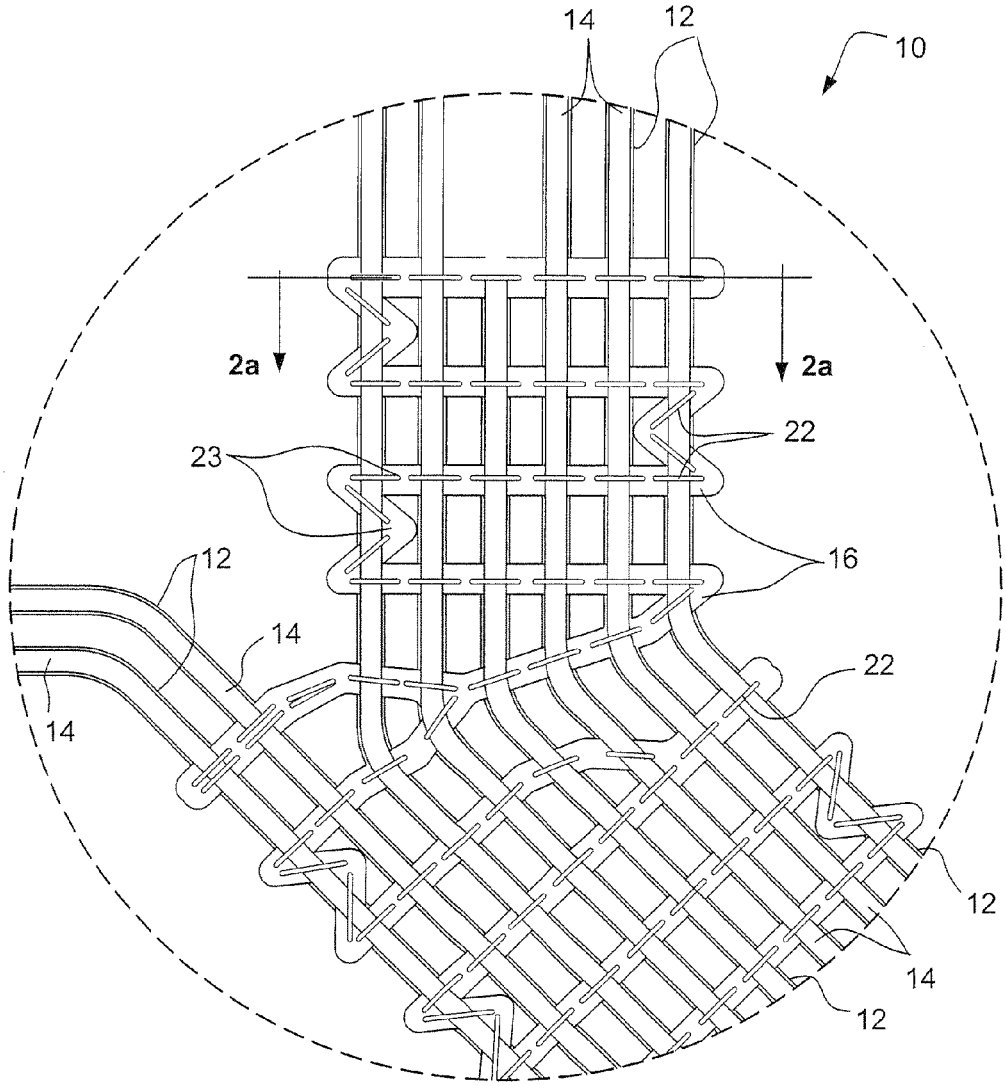
FIG. 1*b* is a view similar to FIG. 1*a* showing the wires positioned in the form and sewn together.
Figure 2A:
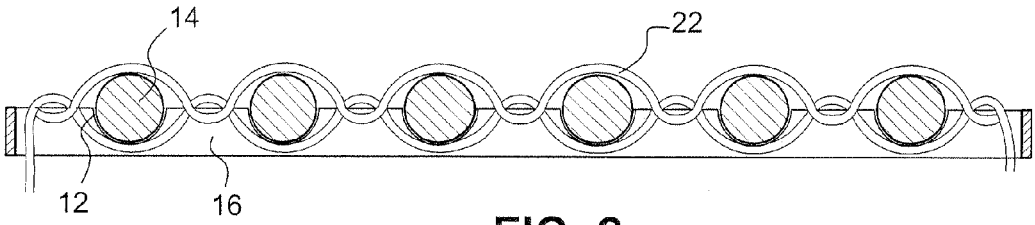
FIG. 2*a* is a sectional view taken along line A-A in FIG. 1*b;*
Figure 2B:
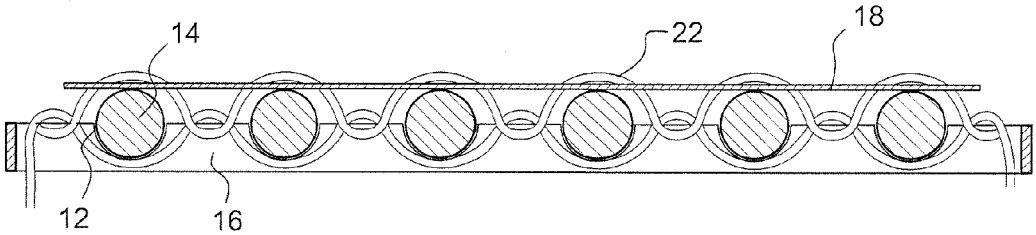
FIG. 2*b* is a view similar to FIG. 2*a* showing a cloth sewn together with the wires.
Figure 5:
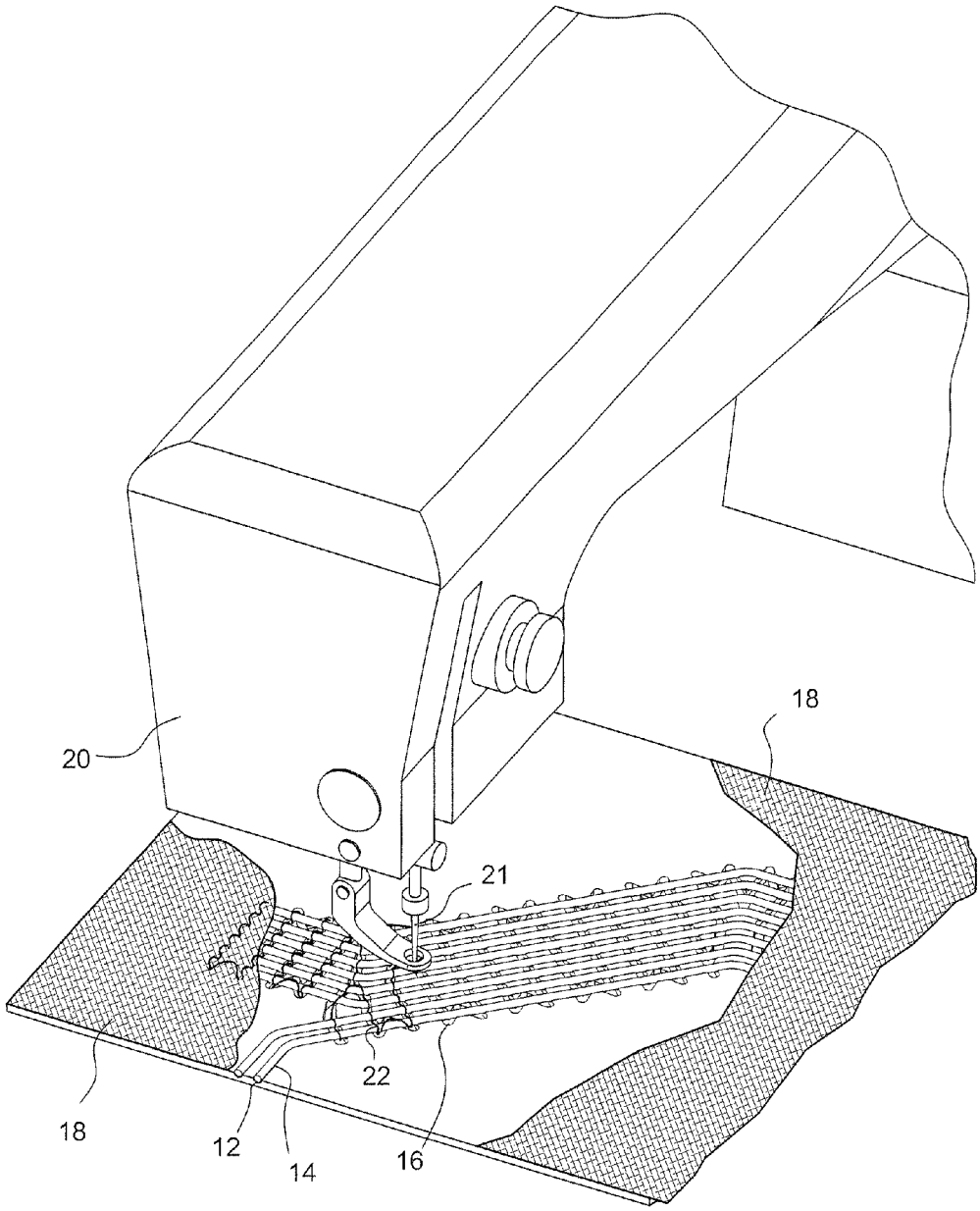
FIG. 5 is a perspective view showing the sewing of the wires and a cloth in the form shown in FIGS. 1 and 1*a*.

A predetermined pattern of connected laterally extending, longitudinally spaced thread openings 16 extends through the form and across the grooves 12, as shown in FIGS. 1 and 1*a*. Once the wires 14 are positioned in the grooves 12 in the predetermined or desired orientation, a cloth 18 may be positioned over the wires 14 in accordance with one embodiment and a computed numerically controlled (CNC) sewing machine or quilting machine 20 of any suitable construction may be used to sew the wires 14 and the cloth 18 together by directing a sewing needle 21 and thread 22 through the openings 16 in the form 10 at stitch points 23 between the wires 14, as shown in FIGS. 1*b*, 2*b* and 5. The cloth 18 may be formed of any suitable conductive or nonconductive material. In another embodiment of the method of the present invention, the cloth 18 may be omitted and the wires 14 may be sewn together without a cloth, as shown in FIGS. 1*b* and 2*a*.

Figure 3:
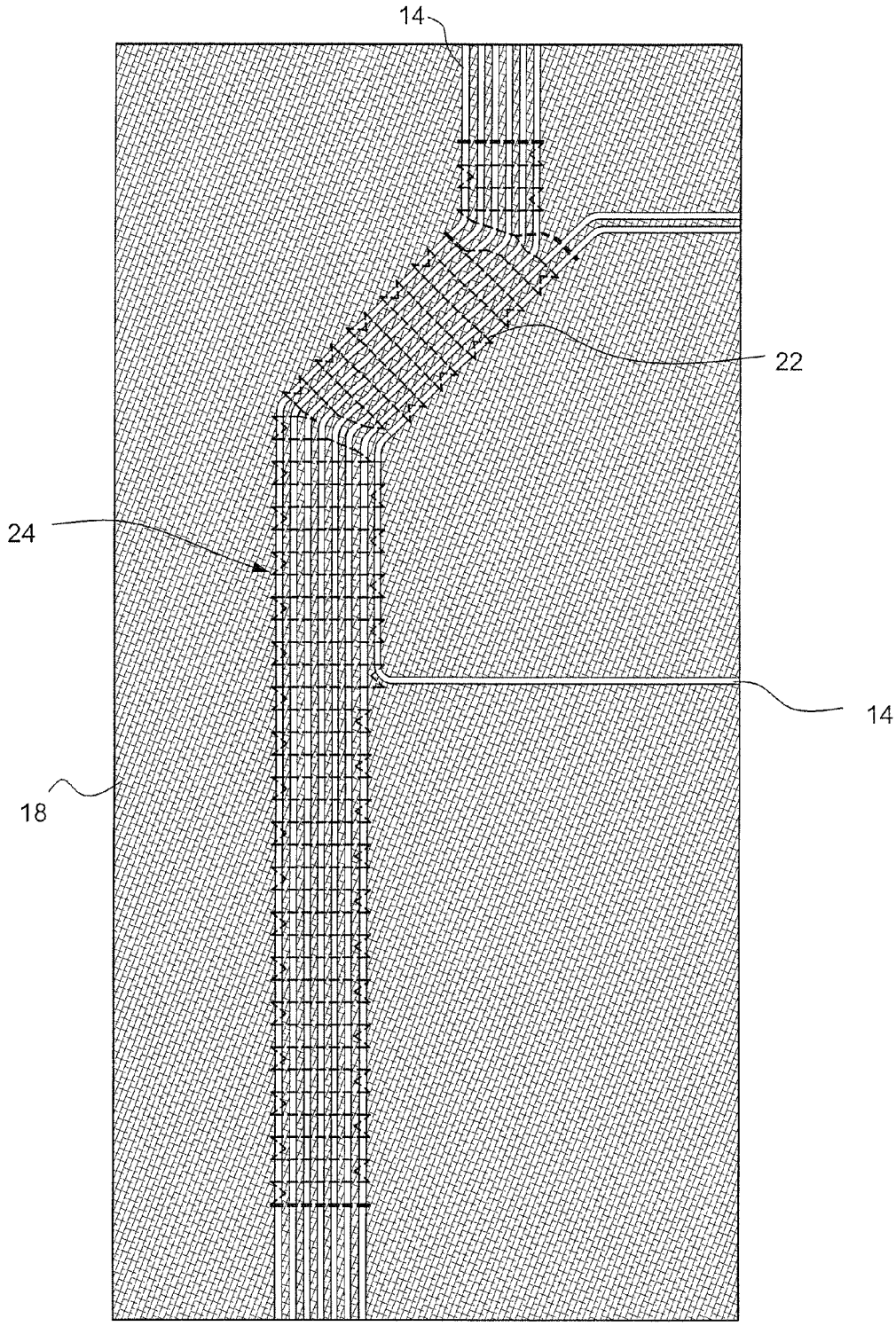
FIG. 3 is a plan view of a wiring harness after a sewing operation in accordance with an embodiment wherein the wires are sewn to a cloth.

The sewing or quilting machine 20 is programmed to guide the sewing needle 21 and thread 22 through the openings 16 and a lockstitch sewing method may be used to capture the wires 14 in the grooves 12 while maintaining them in a flat configuration. When the sewing operation is completed, the stitched wire assembly or harness 24 is removed from the form 10 as shown in FIG. 3.

The thread 22 may be formed of any suitable material such as nylon.

Figure 4:
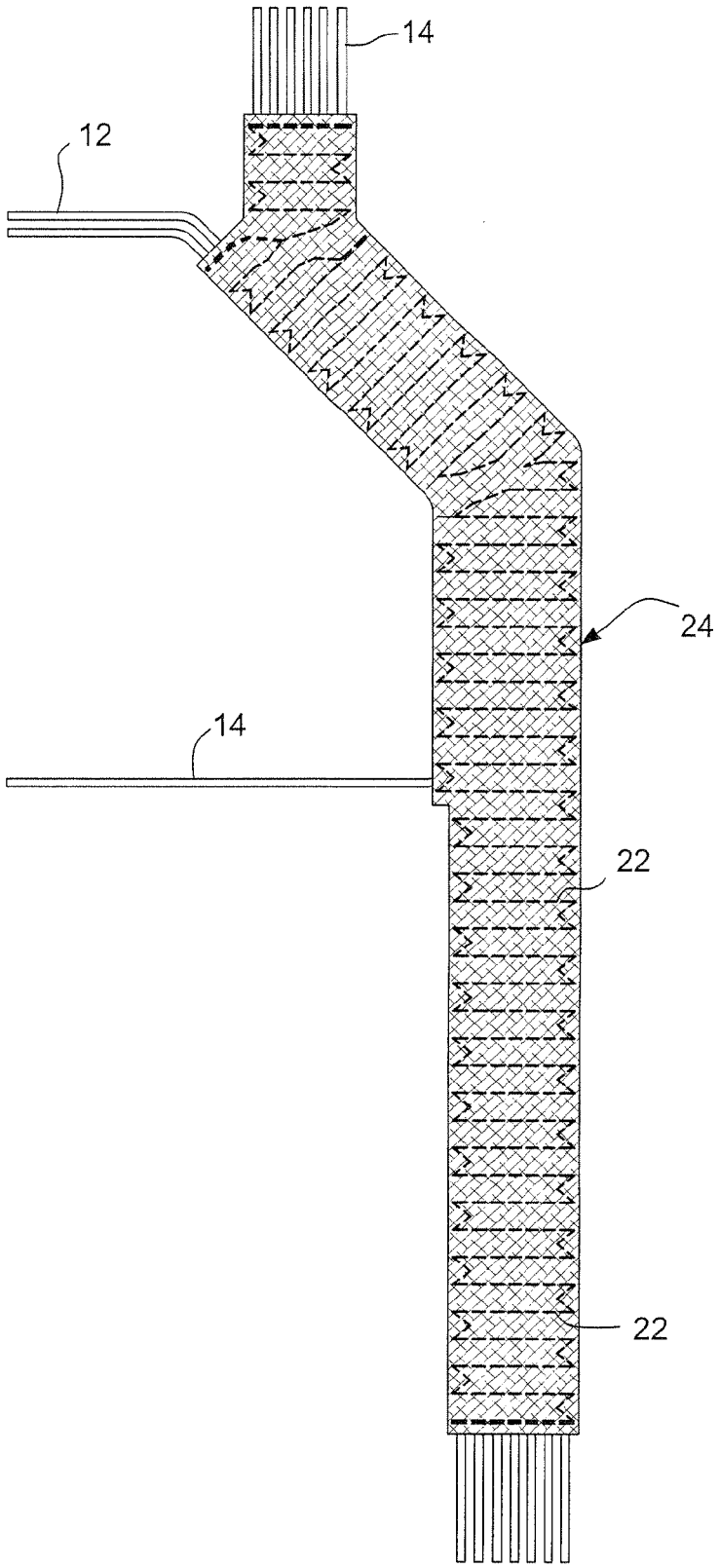
FIG. 4 is a plan view of the sewn wiring harness of FIG. 3 after excess cloth has been trimmed and removed.

Thereafter, if cloth 18 has been used, the excess cloth is removed using a cutter or die or other suitable device so that the finished harness 24 has the configuration shown in FIG. 4.

The wires 14 to be positioned within the grooves 12 of the form 10 may be of any suitable type and may be stripped and tinned, pre-terminated to connectors or may be of normal insulated construction. Preferably, the wires 14 are of a configuration to fit fully within the grooves 12 of the form 10 and each section of wire 14 is fully pressed within the grooves 12 prior to the sewing operation.

The method and apparatus of the present invention, therefore, produces a machine stitched flat wire ribbon or harness 24 that has a low profile so as to be adapted to fit within small areas where space is an issue. The wire ribbon or harness 24 may have any desired combination of number of wires and wire diameters.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of forming with the use of a sewing machine a flat wiring harness having discrete wires in a predetermined orientation, comprising:

positioning discrete wires in longitudinally extending, laterally spaced grooves in a flat form, the grooves having the predetermined orientation and the form having laterally extending, longitudinally spaced thread openings that are connected together and extend through the form and across the grooves, stitching the wires in the grooves together with the use of a sewing machine that is programmed to guide a sewing needle and thread through the openings in the form to produce the flat wiring harness having the discrete wires, and removing the stitched flat wiring harness from the form.

2. The method of claim 1 wherein the sewing machine is a computed numerically controlled (CNC) sewing machine.

3. The method of claim 1 wherein the wires are stitched together by a lockstitch sewing method.

4. The method of claim 1 wherein a cloth is positioned over the wires in the grooves prior to the stitching of the wires, and the cloth is stitched to the wires.

5. The method of claim 4 wherein the cloth is trimmed after being sewn together with the wires to produce the flat wiring harness.

6. The method of claim 4 wherein the cloth is made of a conductive or nonconductive material.

7. The method of claim 1 wherein the grooves are of different sizes and shapes to receive therein different types of discrete wires.

8. The method of claim 1 wherein the discrete wires are fully pressed within the grooves prior to the stitching of the wires.

9. The method of claim 1 wherein the discrete wires may be stripped and tinned, pre-terminated to connectors or of insulated construction.

10. The method of claim 1 wherein the thread openings are in a predetermined pattern and are generally uniformly spaced in the form.

11. A form and sewing machine for forming a flat wiring harness having discrete wires in a predetermined orientation, the form being of flat configuration and comprising:

longitudinally extending, laterally spaced grooves in the predetermined orientation for receiving the wires therein, and connected laterally extending, longitudinally spaced thread openings extending through the form and across the grooves for receiving a sewing needle and thread from the sewing machine to sew wires in the grooves together to form the flat wiring harness.

12. The form and sewing machine of claim 11 wherein the grooves are of different sizes and shapes to receive therein different types of discrete wires.

13. The form and sewing machine of claim 11 wherein the connected thread openings are in a predetermined pattern and are generally uniformly spaced in the form.

* * * * *